United States Patent [19]

Bucourt

[11] Patent Number: 4,518,028

[45] Date of Patent: May 21, 1985

[54] PROCESS AND APPARATUS FOR OBTAINING STACKABLE AUTO-CLAMPING BLOCKS

[75] Inventor: Francois Bucourt, St. Jean de Maurienne, France

[73] Assignee: Aluminium Pechiney, Lyons, France

[21] Appl. No.: 325,433

[22] PCT Filed: Apr. 24, 1981

[86] PCT No.: PCT/FR81/00055

§ 371 Date: Nov. 19, 1981

§ 102(e) Date: Nov. 19, 1981

[87] PCT Pub. No.: WO81/03135

PCT Pub. Date: Nov. 12, 1981

[30] Foreign Application Priority Data

Apr. 28, 1980 [FR] France ..... 80 10116

[51] Int. Cl.[3] ..... B22D 11/12; B22D 11/126

[52] U.S. Cl. ..... 164/460; 164/476; 164/477

[58] Field of Search ..... 164/70.1, 76.1, 263, 164/417, 476, 477, 460; 29/527.5, 527.6, 527.7

[56] References Cited

U.S. PATENT DOCUMENTS

| | | | |
|---|---|---|---|
| 3,066,401 | 12/1962 | Morel et al. | 29/527.6 |
| 3,365,791 | 1/1968 | Olsson | 164/263 X |
| 3,731,512 | 5/1973 | Vogel et al. | 164/263 X |
| 3,746,071 | 7/1973 | Schey | 164/476 X |
| 3,767,178 | 10/1973 | Pfeuffer et al. | 164/263 X |

FOREIGN PATENT DOCUMENTS

| | | | |
|---|---|---|---|
| 1068436 | 11/1959 | Fed. Rep. of Germany | 164/460 |
| 54-07497 | 4/1979 | Japan | 164/263 |

*Primary Examiner*—Kuang Y. Lin
*Assistant Examiner*—Richard K. Seidel
*Attorney, Agent, or Firm*—McDougall, Hersh & Scott

[57] ABSTRACT

A method and apparatus is described for forming non-ferrous, constant section, stackable auto-clamping blocks. The method advantageously utilizes a movable carriage having in addition to cutter means, a pair of jaws which are each generally shaped like a combined prism-trihedron to form mating surfaces in the formed blocks which allows stacking.

7 Claims, 4 Drawing Figures

PROCESS AND APPARATUS FOR OBTAINING STACKABLE AUTO-CLAMPING BLOCKS

This invention concerns a process and apparatus for continuously obtaining by means of a blank of non-ferrous metal delivered from a continuous casting machine, blocks of constant section and having terminal projections from which stackable auto-clamping blocks may subsequently be formed.

The skilled worker knows that it is possible to produce by molds of suitable shape, blocks having parts recessed and/or in relief on one or more of their faces thereby to prevent relative displacement of the blocks, one with regard to the other, when they are assembled in stacks and thus made convenient for transport.

However, this technique involves discontinuous casting operations, block by block, leading to products which have a structure and composition somewhat heterogeneous, varying in weight and being subject to shrinkage on solidification.

For this reason the skilled worker to avoid these disadvantages, has sought to use continuously operating apparatus, notably in the case of blocks in the region of, or less than, a decimeter square, casting machines for casting on a ground wheel closed by a band. The continuous metal blank obtained at the exit of these machines are then divided into separate blocks either by being sawn off individually or, as in the case of French Pat. No. 1,224,969, by stamping followed by shearing.

However, each of these procedures possesses an important inconvenience. Thus, in shearing, besides the rapid wear of the shears, an appreciable amount of metal is spoilt in the chips which must be separated from the cutting lubricant during its recycling. In the procedure by stamping followed by shearing, it is necessary to have a die press, and moreover, the blocks obtained present a lengthwise expansion due to the crushing effect of the die; the result of which may be an irregular section and a variable space between them when they are aligned side by side and, consequently, they permit a relatively poor stack to be realized.

But a major disadvantage of these processes is that, in use, the resulting blocks do not comprise any means suitable to form an assemblage of blocks when they are stacked.

Applicant has searched and perfected a process and apparatus which, in accordance with the practice of this invention, permits continuous manufacture, without loss of metal, of blocks of constant section, presenting the necessary means for erecting stacks of auto-clamping blocks.

The process, according to the invention, consists in the continuous casting of a blank on a grooved wheel temporarily closed by a band and in delivering this blank periodically individually to an appliance for separating it into blocks, characterized by the fact that the blank is first pinched progressively on its lateral faces, in order to form impressions and the development of at least one raised portion on at least one of the other faces, then cut perpendicularly to the impressions.

Thus, the process utilizes, as primary material, a blank issuing from a machine for casting on a grooved wheel temporarily closed by a band to constitute a mold with moving walls.

The blank issuing from the casting machine is first brought back in a horizontal direction to be threaded between the cylinders of a straightener which gives it a suitable alignment, then it is engaged in the apparatus for cutting it into blocks.

This apparatus is mounted on a movable carriage which comprises means for fixing the blank. Thus, under the pressure of the cylinders of the straightener the blank moves the carriage along with it, and this enables the apparatus to move in synchronism with the blank and to carry out its separating action on one definite section thereof. In the course of this synchronous displacement the blank is first pinched progressively on its lateral faces by the apparatus so as to form depressions thereon and to develop at least one raised portion on at least one of the other faces.

These depressions are preferably symmetrical with respect to a vertical plane passing through the axis of the blank and they more or less conform to the slope of the lateral faces. The depth of these depressions may vary according to the nature of the product or the shape of the blank.

The raised portions which are developed on the bottom and/or top face of the blank appear on a section perpendicular to the depressions as two pimples separated by a hollow; these pimples rise above the plane of these faces to a height which may be of the order of 1/10 of the height of the blank and join this face following a convex curve. After being pinched, the blank is cut in a plane perpendicular or, inclined to its axis, across the depressions, that is to say so as to divide the raised portions in their medial plane. Each block thus obtained presents longitudinally a profile in outline at each end which provides the means for making the auto-clamping blocks into a classic stacking system.

On leaving the apparatus each block is subjected to a series of treatments in which the layers are formed where every second block may be turned over in order to bring its lateral faces in close contact with the adjacent block; then the different layers are successively superimposed in a longitudinal sense and in the transverse sense so as to form a stack.

In these stacks, the raised portions are on the two opposite sides of each layer, clamping at the same time the lateral faces of the upper layer and the lower layer, these last layers similarly clamping by their raised portions, the lateral faces of the layer in question. The stacks thus obtained are then suitably bound and may be transported without any risk of relative displacement of the blocks.

The present invention also concerns an apparatus to enable the process above described to be carried into effect.

The apparatus is characterized by the fact that it comprises, mounted on a mobile carriage, two jaws positioned relatively to the lateral faces of the blank and adapted to form depressions therein, and a cutter for severing the blank on at least one part of its section crossing the impressions.

These jaws, which are preferably identical, are constituted by a triangular prism mounted on a trihedron, the base of which is of the same section as the prism. They are arranged respectively with one face against the lateral upright of the carriage while the opposite free faces conform to the line of a vertical plane perpendicular or inclined to the direction of movement of the blank.

In general, the height of each jaw is about the same as the height of the blank so that the depression is made from top to bottom of the lateral surfaces. Associated with these jaws is a cutter fixed on the carriage and the cutting edge of which is disposed at right angles to the line of the jaws. When at rest, the cutting edge of the cutter is disposed slightly behind the line of the passage of the blank.

In action the movement of the carriage, the jaws and the cutter are controlled automatically in accordance with the following sequential steps: the carriage being at rest, the blank is pushed by the straightener between the elements of the apparatus. At the instant when the length of the blank corresponding to the desired length of the blocks has passed in front of the jaws, the carriage is firmly connected to the blank by suitable means and is carried along at the same speed as the blank. This also starts the action of the jaws which pinch the lateral faces of the blank, being progressively force thereon and marking these faces with corresponding depressions. As soon as these depressions have reached the desired depth the jaws quickly withdraw, while the cutter progressively cuts into the blank for at least a part of its section. As the cutter withdraws rapidly, the carriage is released from the blank, initiates a rapid movement contrary to the direction of movement of the blank for a distance corresponding to the length of the block and is again connected rigidly with the blank to commence a fresh cycle of operations.

The present invention will be more readily understood by the aid of the following description with reference to the accompanying drawings which are solely for the purpose of illustration and not limitative.

Figure 1:
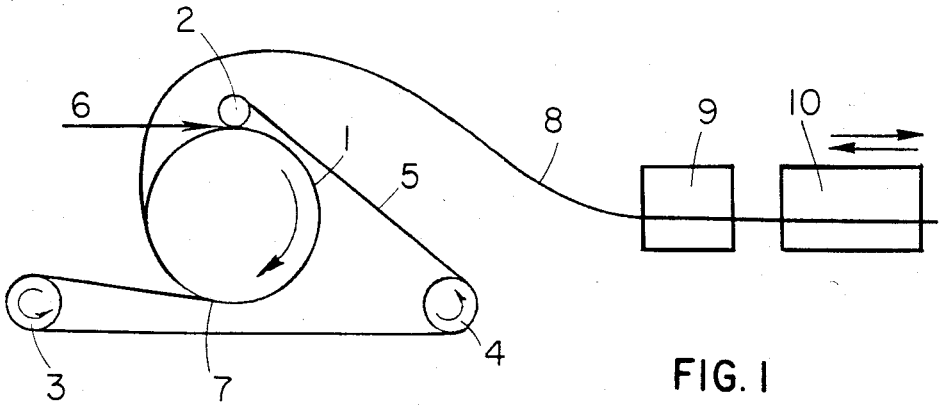
FIG. 1 is a diagrammatic view of an installation for continuous casting, having a carriage assembly according to the invention.

In FIG. 1, may be seen a continuous casting machine with double-flanged wheel of the type having four wheels comprising the casting wheel 1, the three auxiliary wheels 2, 3, 4 and the band 5. The liquid metal is fed into the machine in the direction of arrow 6 and leaves at 7 in the form of a blank casting 8. This blank is fed into a straightener 9; then a mobile carriage 10 equipped with jaws and a cutter.

Figure 2:
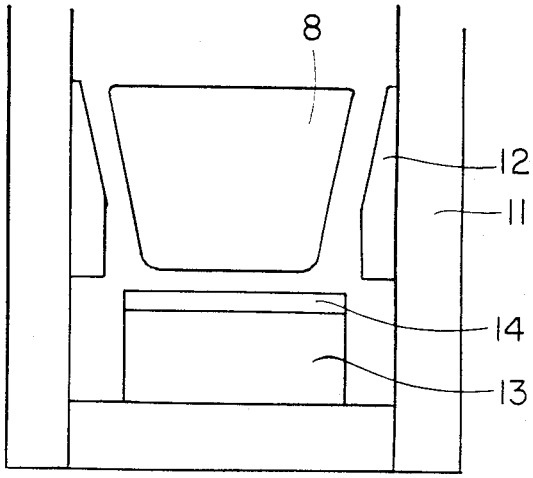
FIG. 2 is a sectional view of an enlarged scale of the carriage assembly taken at right angles to FIG. 1.

FIG. 2 is a section taken perpendicular to the direction of displacement of the carriage assembly, where may be seen, on the one hand, attached to each of the uprights 11, the jaws 12 and the cutter 13 with its cutting edge 14, and on the other hand, the blank 8 to be cut into sections of desired length.

Figure 3:
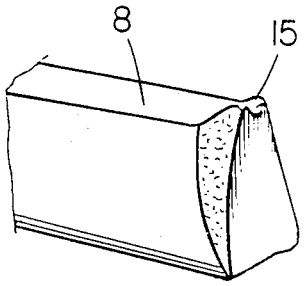
FIG. 3 shows in perspective one end of a block obtained by the process according to the invention.

FIG. 3 is a perspective view of an end portion of the block showing the projections 15 which permit the blocks to be jammed together.

Figure 4:
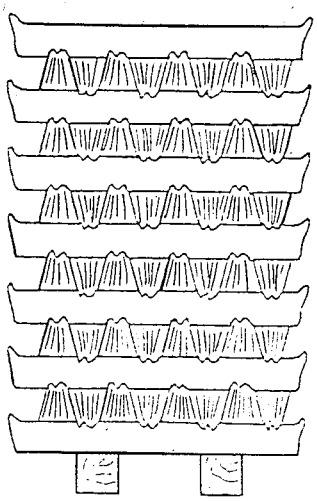
FIG. 4 represents a stack of auto-clamping blocks obtained according to the invention.

FIG. 4 represents an assembly of the auto-clamping blocks produced according to the invention.

The present invention has application particularly in the aluminum industry, in all cases where starting with a product of continuous casting, it is sought to obtain blocks of constant section and predetermined length from which a stack of auto-clamping blocks may be built.

I claim:

1. A process for forming stackable autoclamping blocks from metal blocks of constant section comprising providing a rough-cast blank of a continuous casting machine of the grooved-wheel type, said blank defining lateral faces and top and bottom faces, periodically connecting the blank solidly to an apparatus for dividing it into blocks, characterized by the steps of progressively pinching the blank on its lateral faces in order to form depressions in the lateral faces, and to develop on at least one of the top and bottom faces at least one projection rising above the plane of the one face to the height of the order of 1/10 of the height of the blank, and then cutting the blank across the depression and through the medial plane of the projection to form individual blocks, and having a portion of said projection adjacent the respective ends of the individual blocks.

2. A process as defined in claim 1 wherein said metal of constant section is non-ferrous.

3. A process as defined in claim 1 wherein said pinching utilizes a pair of jaws adapted to form said depressions in said lateral faces.

4. A process as defined in claim 3 wherein said jaws comprise a triangular prism mounted on a trihedron, said trihedron having a base of the same section as said prism and wherein jaws are adapted to form at least one depression from the top to the bottom of each lateral surface and said depressions are so formed.

5. Stackable auto-clamping blocks formed from metal blocks of constant section by the process comprising providing a rought-cast blank of a continuous casting machine of the grooved-wheel type, said blank defining lateral faces and top and bottom faces, and periodically connecting the blank solidly to an apparatus for dividing it into blocks, the process being characterized by the steps of progressively pinching the blank on its lateral faces in order to form depressions in the lateral faces, and to develop on at least one of the top and bottom faces at least one projection rising above the plane of the one face to a height of the order of 1/10 of the height of the blank, and then cutting the blank across the depressions and dividing the projection through its medial plane to form individual blocks each having a portion of said projection adjacent the respective ends of the individual blocks.

6. Stackable auto-clamping blocks as defined in claim 5 wherein said metal blocks of constant section are non-ferrous.

7. Stackable auto-clamping blocks as defined in claim 5 wherein said pinching utilizes a pair of jaws adapted to form said depressions from top to bottom of said lateral faces.

* * * * *